US007438567B2

(12) United States Patent
Nalwad et al.

(10) Patent No.: US 7,438,567 B2
(45) Date of Patent: Oct. 21, 2008

(54) SAFETY MECHANISM, ELECTRICAL OUTLET CONTAINING SAME, AND METHOD OF MANUFACTURING SAME

(75) Inventors: Vijendra Nalwad, Newbury Park, CA (US); Vincent Razo, Granada Hills, CA (US); Tyler Sheble, Redondo Beach, CA (US); John Wadsworth, Los Angeles, CA (US)

(73) Assignee: Belkin International Inc., Compton, CA (US)

( * ) Notice: Subject to any disclaimer, the term of this patent is extended or adjusted under 35 U.S.C. 154(b) by 134 days.

(21) Appl. No.: 11/024,593

(22) Filed: Dec. 28, 2004

(65) Prior Publication Data

US 2007/0049079 A1 Mar. 1, 2007

(51) Int. Cl.
*H01R 13/44* (2006.01)

(52) U.S. Cl. ..... 439/143; 439/137

(58) Field of Classification Search ..... 439/137, 439/138, 142, 143
See application file for complete search history.

(56) References Cited

U.S. PATENT DOCUMENTS 2,452,922 A * 11/1948 Gonsett et al. ..... 174/67
3,428,936 A * 2/1969 Arnao, Jr. ..... 439/144
3,749,815 A * 7/1973 Boatwright et al. ..... 174/66
4,302,624 A * 11/1981 Newman ..... 174/67
5,007,848 A 4/1991 Lee
5,096,432 A * 3/1992 Cullen et al. ..... 439/139
5,702,259 A 12/1997 Lee
5,885,109 A 3/1999 Lee et al.
6,364,673 B1 * 4/2002 Lee ..... 439/139
2007/0049079 A1 * 3/2007 Nalwad et al. ..... 439/137

FOREIGN PATENT DOCUMENTS

| | | |
|---|---|---|
| AU | 198939426 A1 | 6/1991 |
| BR | 8904437 A | 5/1991 |
| CA | 1309475 | 10/1992 |
| EP | 0 411 216 B1 | 3/1996 |

* cited by examiner

*Primary Examiner*—James Harvey
(74) *Attorney, Agent, or Firm*—Bryan Cave LLP

(57) ABSTRACT

A safety mechanism capable of blocking an opening to an electrical connection in an electrical outlet includes a safety barrier coupled to the electrical outlet at a pivot point and a biasing member adjacent to the safety barrier. The safety barrier is rotatable between a first position, in which the safety barrier blocks the opening, and a second position, in which the safety barrier does not block the opening. The biasing member biases the safety barrier toward the first position. In the same or another embodiment of the invention, the safety mechanism forms a part of one or more electrical outlets contained in an electrical product.

26 Claims, 5 Drawing Sheets

SAFETY MECHANISM, ELECTRICAL OUTLET CONTAINING SAME, AND METHOD OF MANUFACTURING SAME

FIELD OF THE INVENTION

This invention relates generally to safety devices for electrical outlets, and relates more particularly to safety covers for electrical outlets.

BACKGROUND OF THE INVENTION

Electrical power outlets carry electric currents at a level sufficient to cause serious physical injury or death to one who is exposed to such currents. The death toll due to accidental electrocution is not high compared to total population, but neither is it insignificant, with accidental electrocution claiming, for example, between 500 and 1,000 lives every year in the United States. A greater number of people suffer non-fatal but still serious and/or painful electricity-related injuries, and household wiring is involved in a majority of these incidents. Unprotected power outlets therefore pose significant safety risks, yet power outlets are nearly ubiquitous in modem society, with dozens of them existing in a typical home.

Outlet covers designed to prevent accidental contact with dangerous electrical currents have been developed, but the existing outlet covers either fail to cover all of the outlet openings, must be manually removed before the outlet can be used, in what is often a rather difficult or inconvenient procedure, or suffer from some other drawback. Accordingly, there exists a need for an outlet safety barrier that covers all openings of an outlet and that moves aside easily, conveniently, and automatically when an electrical plug inserted, but is much more difficult to move aside under other circumstances.

BRIEF DESCRIPTION OF THE DRAWINGS

The invention will be better understood from a reading of the following detailed description, taken in conjunction with the accompanying figures in the drawings in which.

Figure 1:
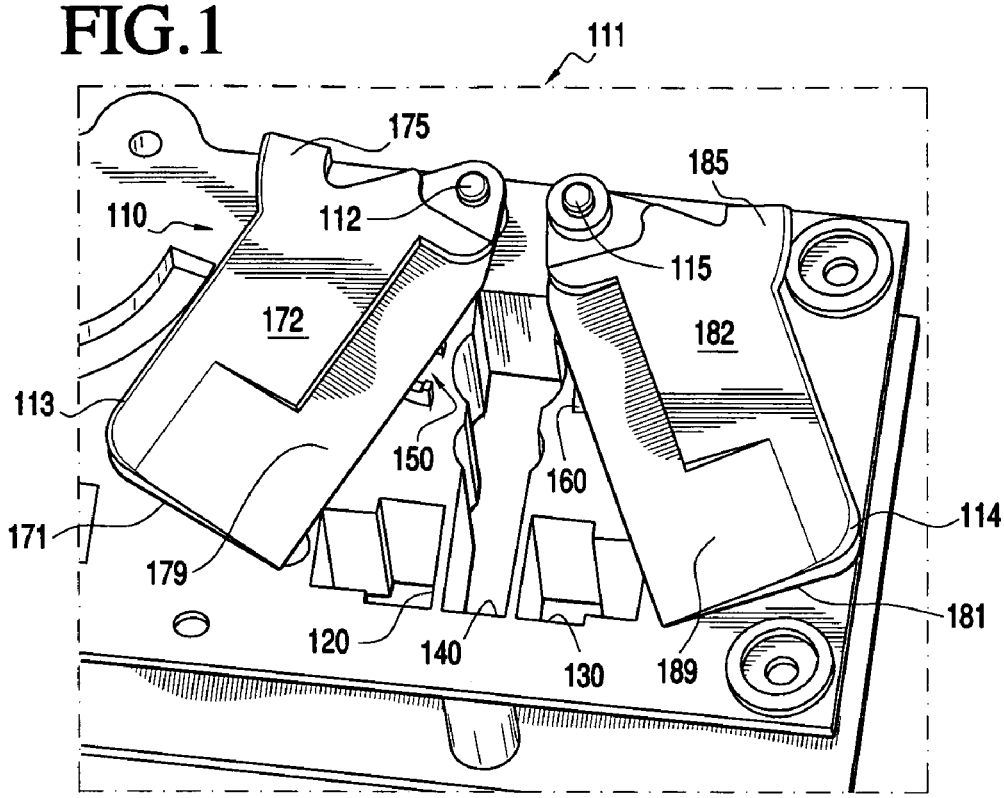
FIG. 1 is a perspective view of a safety mechanism capable of blocking an opening to an electrical connection in an electrical outlet according to an embodiment of the invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "comprise," "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical, mechanical, or other manner.

DETAILED DESCRIPTION OF THE DRAWINGS

In one embodiment of the invention, a safety mechanism capable of blocking an opening to an electrical connection in an electrical outlet comprises a safety barrier coupled to the electrical outlet at a pivot point and a biasing member coupled to the safety barrier. The safety barrier is rotatable between a first position, in which the safety barrier blocks the opening, and a second position, in which the safety barrier does not block the opening. The biasing member biases the safety barrier toward the first position. In the same or another embodiment of the invention, the safety mechanism forms a part of one or more electrical outlets contained in an electrical product.

The safety mechanism described above makes potentially harmful contact with a live electrical outlet less likely, thus helping to reduce the number of incidents in which a person receives an electric shock from household wiring. As described in detail below, the safety mechanism reduces the likelihood of such potentially harmful contact by blocking, when appropriate, the openings that lead to the live electrical connections inside an electrical outlet.

Referring now to the figures, FIG. 1 is a perspective view of a safety mechanism 110 capable of blocking an opening 120 to an electrical connection in an electrical outlet according to an embodiment of the invention. The electrical connection is not illustrated in FIG. 1, but is located in opening 120 and comprises an electrically conductive material electrically coupled to a source of electric current. Safety mechanism 110 comprises a safety barrier 111 coupled to the electrical outlet at a pivot point 112. Safety barrier 111 is rotatable between a first position, in which safety barrier 111 blocks opening 120, and a second position, in which safety barrier 111 does not block opening 120.

It is well known that different regions of the world have differing electrical standards, and that one consequence of these differing standards is that a plug that will fit into an electrical outlet in one country may not fit into an electrical outlet in another country. Some countries, recognizing this incompatibility, have developed universal outlets capable of receiving plugs in a wide variety of configurations, standards, and specifications. China, for example, is one country in which universal outlets are at least somewhat common. Although safety mechanism 110 may be beneficially used with electrical outlets in many configurations, its use in this document will be described and illustrated with respect to a universal outlet, a portion of which is shown in FIG. 1. Additional safety mechanisms according to additional embodiments of the invention will also be described and illustrated with respect to a universal outlet, although they too may be beneficially used with electrical outlets in many different configurations.

Referring again to FIG. 1, the electrical outlet comprises not only opening 120 but also an opening 130 and an opening 140. As an example, opening 120 leads to a hot electrical connection, opening 130 leads to a neutral electrical connection, and opening 140 leads to a grounded electrical connection. Alternatively, opening 120 could lead to the neutral electrical connection and opening 130 could lead to the hot electrical connection.

In the embodiment illustrated in FIG. 1, safety barrier 111 comprises a shutter 113 coupled to the electrical outlet at pivot point 112, and further comprises a shutter 114 coupled to the electrical outlet at a pivot point 115. Other configurations are also possible, and some of those other configurations will be shown in subsequent figures and described below. In a non-illustrated embodiment, safety barrier 111 includes only one of shutters 113 and 114, and that single shutter blocks access to opening 120 when the single shutter is in the first position. In one manifestation of the non-illustrated embodiment, the single shutter blocks each one of openings 120, 130, and 140. Referring again to the embodiment illustrated in FIG. 1, shutter 113 blocks opening 120 and a portion of opening 140, and shutter 114 blocks opening 130 and a complementary portion of opening 140 such that each opening in the electrical outlet is blocked. With every opening blocked, the likelihood is greatly reduced that a person will come into contact with an electrical current at the electrical outlet.

Safety mechanism 110 further comprises a channel 150 under shutter 113 and a channel 160 under shutter 114. A biasing member (not shown in FIG. 1) adjacent to safety barrier 111 biases safety barrier 111 toward the first position. In one embodiment, the biasing member comprises a spring. Although FIG. 1 depicts safety barrier 111 at rest in the second position, in which openings 120, 130, and 140 are exposed rather than blocked, such depiction is for illustrative purposes only, and the biasing member under normal operation would push safety barrier 111 across the openings and into the first position, and would not allow safety barrier 111 to remain in the second position unassisted.

In one embodiment, safety mechanism 110 comprises two biasing members, one for each of shutters 113 and 114. In at least one manifestation of that embodiment, one of the biasing members is adjacent to shutter 113, in channel 150, the other biasing member is adjacent to shutter 114, in channel 160, and shutters 113 and 114 can move independently of each other.

Shutter 113 of safety barrier 111 comprises an extension arm 175 oriented so as to be located over channel 150 when safety barrier 111 is in the first position. Similarly, shutter 114 of safety barrier 111 comprises an extension arm 185 oriented so as to be located over channel 160 when safety barrier 111 is in the first position. This orientation of extension arms 175 and 185 tends to keep the biasing members in place within channels 150 and 160. When safety barrier 111 is in the second position, surfaces 171 and 181 perform an equivalent function. In the absence of extension arms 175 and 185 or another component that performs an equivalent function, the biasing members may have a tendency to leave channels 150 and 160, with possible detrimental effect to safety mechanism 110.

The discussion thus far has focused on the ability of safety mechanism 110 to block the openings in an electrical outlet, thereby increasing safety by reducing the likelihood of electrocution. There will of course be many times, however, when unfettered access to the electrical outlet will be desired, and at those times safety barrier 111 must be moved from the first position to the second position, i.e., be moved out of the way so as to no longer block the openings in the electrical outlet. In order to accomplish such movement automatically, without requiring direct manipulation of safety barrier 111 by hand, shutter 113 comprises a surface 171 facing the electrical connections and a surface 172 opposite surface 171 and facing away from the electrical connections. Similarly, shutter 114 comprises a surface 181 facing the electrical connections and a surface 182 opposite surface 181 and facing away from the electrical connections. (Surfaces 171 and 181 are hidden from view in FIG. 1 by surfaces 172 and 182, respectively, such that only an edge of surface 171 and an edge of surface 181 are visible.)

A portion 179 of surface 172 is angled with respect to surface 171, and a portion 189 of surface 182 is angled with respect to surface 181, such that portions 179 and 189 slope toward each other, forming a "V"-shape. When the prongs of a plug (not shown) are pushed against portion 179 and portion 189, the resulting force has a first component that is perpendicular to surfaces 171 and 181 and a second component that is parallel to surfaces 171 and 181. It is the parallel component that tends to rotate shutter 113 about pivot point 112, and shutter 114 about pivot point 115, thus exposing openings 120, 130 and 140.

Figure 2:
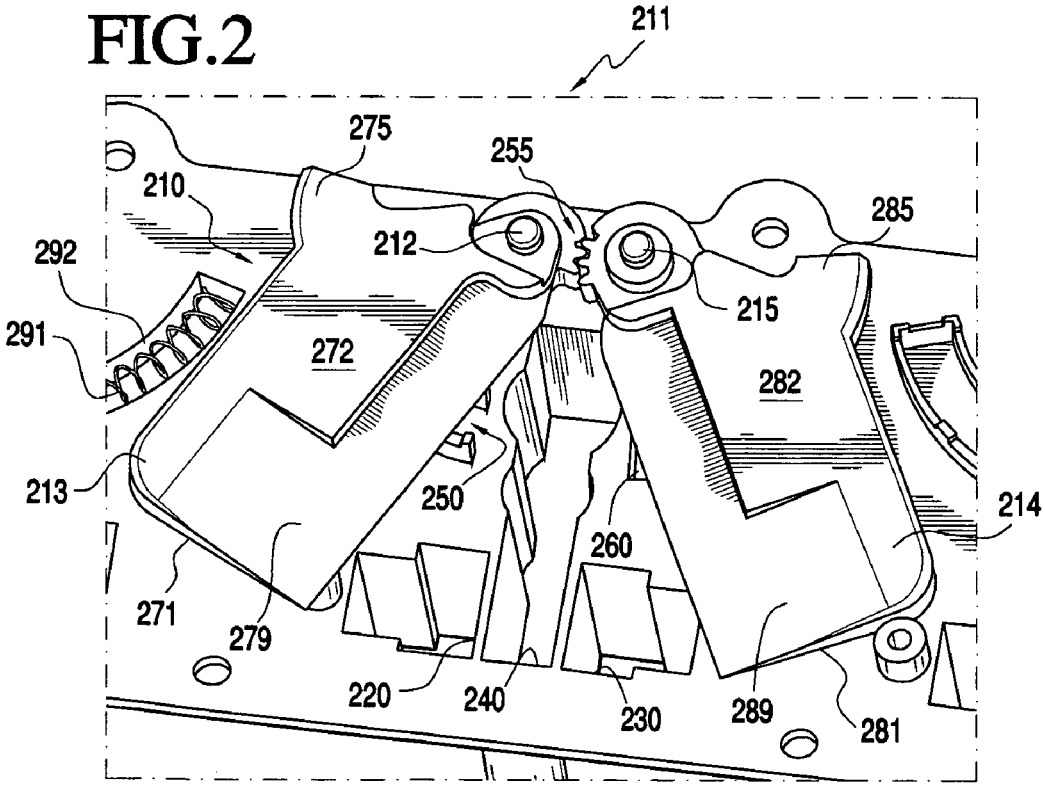
FIG. 2 is a perspective view of a safety mechanism capable of blocking an opening to an electrical connection in an electrical outlet according to another embodiment of the invention.

FIG. 2 is a perspective view of a safety mechanism 210 capable of blocking an opening 220 to an electrical connection in an electrical outlet according to an embodiment of the invention. As was the case in FIG. 1, the electrical connection is not illustrated in FIG. 2, but is located in opening 220 and comprises an electrically conductive material electrically coupled to a source of electric current. The electrical outlet illustrated in FIG. 2 comprises an opening 230 and an opening 240 in addition to opening 220. As an example, openings 220, 230, and 240 can be similar to, respectively, openings 120, 130, and 140, all of which were first shown in FIG. 1. Safety mechanism 210 comprises a safety barrier 211, which is rotatable between a first position, in which safety barrier 211 blocks openings 220, 230, and 240, and a second position, in which safety barrier 211 does not block any of openings 220, 230, or 240.

In the preceding paragraph, a newly-described element of an embodiment of the invention was described as being similar to a previously-described element of an embodiment of the invention. It is to be understood that everywhere such comparisons are made herein, the phrase "can be similar to" means the compared elements can be similar to each other not only in structure but also in the function they perform.

In the illustrated embodiment, safety barrier 211 comprises a shutter 213 coupled to the electrical outlet at a pivot point 212, and a shutter 214 coupled to the electrical outlet at a pivot point 215. Shutter 213 comprises a surface 271 facing the electrical connections and a surface 272 opposite surface 271 and facing away from the electrical connections. Similarly, shutter 214 comprises a surface 281 facing the electrical connections and a surface 282 opposite surface 281 and facing away from the electrical connections. (Surfaces 271 and 281 are hidden from view in FIG. 2 by surfaces 272 and 282, respectively, such that only an edge of surface 271 and an edge of surface 281 are visible.) Surface 272 comprises a portion 279 that is angled with respect to surface 271, and surface 282 comprises a portion 289 that is angled with respect to surface 281. As an example, pivot points 212 and 215, surfaces 271, 272, 281, and 282, and portions 279 and 289 can be similar to, respectively, pivot points 112 and 115, surfaces 171, 172, 181, and 182, and portions 179 and 189, all of which were first shown in FIG. 1.

Safety mechanism 210 further comprises a biasing member adjacent to safety barrier 211 that biases safety barrier 211 toward the first position. The biasing member of safety mechanism 210 is not visible in FIG. 2, but FIG. 2 does illustrate a biasing member 291, in the form of a spring, located in a channel 292. Biasing member 291 and channel 292 are the only illustrated components of a different safety mechanism, not further described here, located adjacent to safety mechanism 210. Safety mechanism 210 still further comprises a channel 250 and a channel 260. If a biasing member were visible in FIG. 2, it would, in one embodiment, be located in one of channels 250 and 260.

Shutter 213 of safety barrier 211 comprises an extension arm 275 oriented so as to be located over channel 250 when safety barrier 211 is in the first position. Similarly, shutter 214 of safety barrier 211 comprises an extension arm 285 oriented so as to be located over channel 260 when safety barrier 211 is in the first position. This orientation of extension arms 275 and 285 tends to keep the biasing members in place within channels 250 and 260. When safety barrier 211 is in the second position, surfaces 271 and 281 perform an equivalent function. In the absence of extension arms 275 and 285 or another component that performs an equivalent function, the biasing members may have a tendency to leave channels 250 and 260, with possible detrimental effect to safety mechanism 210.

With respect to the details and components described thus far, safety mechanism 210 is similar to safety mechanism 110 of FIG. 1. A difference between safety mechanism 210 and safety mechanism 110 will now be described with reference to a coupling mechanism 255 of safety mechanism 210, a component that has no counterpart in safety mechanism 110. Coupling mechanism 255 links together shutter 213 and shutter 214. In the illustrated embodiment, coupling mechanism 255 comprises a system of interlaced gear teeth referred to herein as a gear system. Other types of coupling mechanisms are also possible. As an example, the coupling mechanism can comprise a slot and pin arrangement of the type disclosed in U.S. Pat. No. 6,484,777, which patent is commonly owned with the invention described herein, and which is hereby incorporated herein by reference.

Coupling mechanism 255 in safety mechanism 210 forces shutters 213 and 214 to move in synchronization, where any movement of one shutter leads to a corresponding movement in the other shutter, while the absence of a coupling mechanism in safety mechanism 110 allows shutters 113 and 114 to move independently of each other. One potential advantage made possible by coupling mechanism 255 is that safety mechanism 210 requires only one biasing member, unlike safety mechanism 110, which requires two. A further advantage of coupling mechanism 255 is that it may make safety mechanism 210 easier to open when an electric plug is pressed against safety mechanism 210, because motion of one shutter will assist motion of the other shutter.

Figure 3:
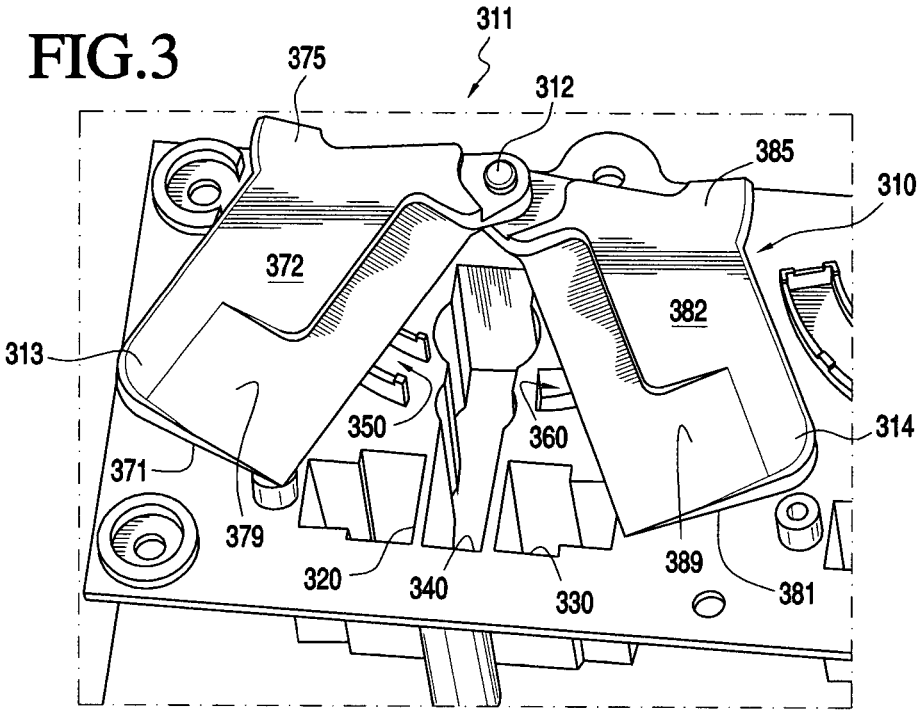
FIG. 3 is a perspective view of a safety mechanism capable of blocking an opening to an electrical connection in an electrical outlet according to yet another embodiment of the invention.

FIG. 3 is a perspective view of a safety mechanism 310 capable of blocking an opening 320 to an electrical connection in an electrical outlet according to an embodiment of the invention. As was the case in FIGS. 1 and 2, the electrical connection is not illustrated in FIG. 3, but is located in opening 320 and comprises an electrically conductive material electrically coupled to a source of electric current. The electrical outlet illustrated in FIG. 3 comprises an opening 330 and an opening 340 in addition to opening 320. As an example, openings 320, 330, and 340 can be similar to, respectively, openings 120, 130, and 140, all of which were first shown in FIG. 1. Safety mechanism 310 comprises a safety barrier 311, which is rotatable between a first position, in which safety barrier 311 blocks openings 320, 330, and 340, and a second position, in which safety barrier 311 does not block any of openings 320, 330, or 340.

In the illustrated embodiment, safety barrier 311 comprises a shutter 313 and a shutter 314 coupled to the electrical outlet at a pivot point 312. Because shutters 313 and 314 share a single pivot point, the shutters can be closer together than shutters 213 and 214 and shutters 113 and 114, each of which have their own separate pivot point, enabling a more compact footprint for safety mechanism 310 than is possible for safety mechanisms 110 and 210.

Shutter 313 comprises a surface 371 facing the electrical connections and a surface 372 opposite surface 371 and facing away from the electrical connections. Similarly, shutter 314 comprises a surface 381 facing the electrical connections and a surface 382 opposite surface 381 and facing away from the electrical connections. (Surfaces 371 and 381 are hidden from view in FIG. 3 by surfaces 372 and 382, respectively, such that only an edge of surface 371 and an edge of surface 381 are visible.) Surface 372 comprises a portion 379 that is angled with respect to surface 371, and surface 382 comprises a portion 389 that is angled with respect to surface 381. As an example, pivot point 312, surfaces 371, 372, 381, and 382, and portions 379 and 389 can be similar to, respectively, pivot point 112, surfaces 171, 172, 181, and 182, and portions 179 and 189, all of which were first shown in FIG. 1.

Safety mechanism 310 further comprises a channel 350, a channel 360, and biasing members (not shown) adjacent to safety barrier 311 that bias shutters 313 and 314 toward the first position. Neither biasing member of safety mechanism 310 is visible in FIG. 3. In one embodiment, one biasing member is located in channel 350 and another biasing member is located in channel 360.

Shutter 313 of safety barrier 311 comprises an extension arm 375 oriented so as to be located over channel 350 when safety barrier 311 is in the first position. Similarly, shutter 314 of safety barrier 311 comprises an extension arm 385 oriented so as to be located over channel 360 when safety barrier 311 is in the first position. This orientation of extension arms 375 and 385 tends to keep the biasing members in place within channels 350 and 360. When safety barrier 311 is in the second position, surfaces 371 and 381 perform an equivalent function. In the absence of extension arms 375 and 385 or another component that performs an equivalent function, the biasing members may have a tendency to leave channels 350 and 360, with possible detrimental effect to safety mechanism 310.

In a non-illustrated embodiment, safety mechanism 310 comprises a coupling mechanism that can be similar to coupling mechanism 255 of safety mechanism 210, both of which are shown in FIG. 2. In one manifestation, the coupling mechanism that forms a part of the non-illustrated embodiment of safety mechanism 310 comprises a gear system in which a portion of surface 382, and a corresponding portion of surface 371, both of which portions are near pivot point 312, are provided with gears known as face gears. These face gears operate in a manner similar to the gears in the illustrated embodiment of coupling mechanism 255.

Figure 4:
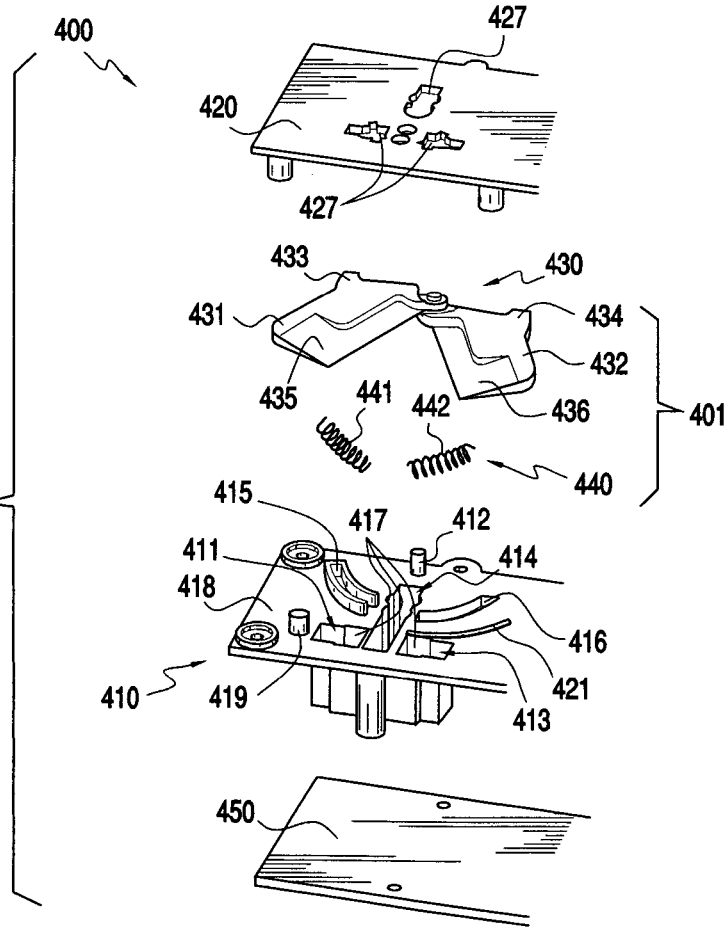
FIG. 4 is an exploded view of an electrical outlet according to an embodiment of the invention.

FIG. 4 is an exploded view of an electrical outlet 400 according to an embodiment of the invention. As illustrated in FIG. 4, electrical outlet 400 comprises a body 410 containing a plurality of electrical connections 417, a faceplate 420 covering body 410 and having therein a plurality of openings 427 corresponding to plurality of electrical connections 417, a safety barrier 430 between faceplate 420 and body 410, and a biasing member 440 adjacent to safety barrier 430. In the illustrated embodiment, biasing member 440 comprises a spring 441 and a spring 442. Electrical outlet 400 further comprises a bottom plate 450 opposite faceplate 420 and containing body 410, safety barrier 430, and biasing member 440 between it and faceplate 420.

Safety barrier 430 comprises a portion 435 and a portion 436 that are angled with respect to faceplate 420. Safety barrier 430 is coupled to body 410 at a pivot point 412. Safety barrier 430 is rotatable between a first position, in which safety barrier 430 blocks each one of plurality of openings 427, and a second position, in which safety barrier 430 does not block any of plurality of openings 427. Biasing member 440 biases safety barrier 430 toward the first position. As an example, safety barrier 430, portions 435 and 436, and pivot point 412 can be similar to, respectively, safety barrier 111, portions 179 and 189, and pivot point 112, all of which were shown in FIG. 1. Safety barrier 430 and biasing member 440 are portions of a safety mechanism 401.

Safety barrier 430 comprises a shutter 431 coupled to body 410 at pivot point 412 and a shutter 432 also coupled to body 410 at pivot point 412. Accordingly, safety mechanism 401 is similar to safety mechanism 310, shown in FIG. 3, in that both safety mechanisms contain a single pivot point. Although they are not illustrated in FIG. 4, different embodiments of electrical outlet 400 could be similar to safety mechanisms 110 and 210 from FIGS. 1 and 2, respectively. Referring again to the illustrated embodiment, spring 441 is adjacent to shutter 431, spring 442 is adjacent to shutter 432, and shutter 431 and shutter 432 are capable of moving independently of each other. Shutter 431 comprises an extension arm 433, and shutter 432 comprises an extension arm 434. As an example, extension arm 433 can be similar to extension arms 175, 275, or 375 from FIGS. 1, 2, and 3, respectively, and extension arm 434 can be similar to extension arms 185, 285, or 385, also from FIGS. 1, 2, and 3, respectively.

Body 410 comprises a cavity 411 containing a hot electrical connection, a cavity 413 containing a neutral electrical connection, and a cavity 414 containing a ground electrical connection. Alternatively, cavity 413 contains the hot electrical connection, and cavity 411 contains the neutral electrical connection. The hot, neutral, and ground electrical connections are at least some of plurality of electrical connections 417. As first described above, electrical outlet 400 is a universal outlet designed to receive plugs of configurations, standards, and specifications used in many if not most countries around the world. That universal design explains the oblong or oversized cavities that may appear unusual to those accustomed to electrical outlets adapted only for a single standard.

Body 410 further comprises a channel 415 capable of housing spring 441, a channel 416 capable of housing spring 442, and a surface 418 adjacent to channels 415 and 416 and to cavities 411, 413, and 414. In the embodiment illustrated in FIG. 4, pivot point 412 comprises a post located on surface 418 of body 410 and extending away from body 410 toward faceplate 420. Pivot points 112, 115, 212, 215, and 312 from FIGS. 1-3 can each have similar constructions.

Body 410 still further comprises a support feature 419 and a friction-reducing feature 421 on surface 418. Support feature 419 acts to prevent or reduce bending of safety barrier 430 when a plug is pressed against safety barrier 430. Friction-reducing feature 421 comprises a raised rib or ridge, possibly having an arched top, rising above surface 418 and offering a travel path for shutter 432 that generates less friction between it and shutter 432 than would surface 418 itself. This reduced friction is due at least in part to the fact that shutter 432 and friction-reducing feature 421 are in contact across a smaller surface area than shutter 432 and surface 418 would be. Support feature 419, in addition to performing the function discussed above, may also reduce friction between shutter 431 and surface 418 for a similar reason.

Figure 5:
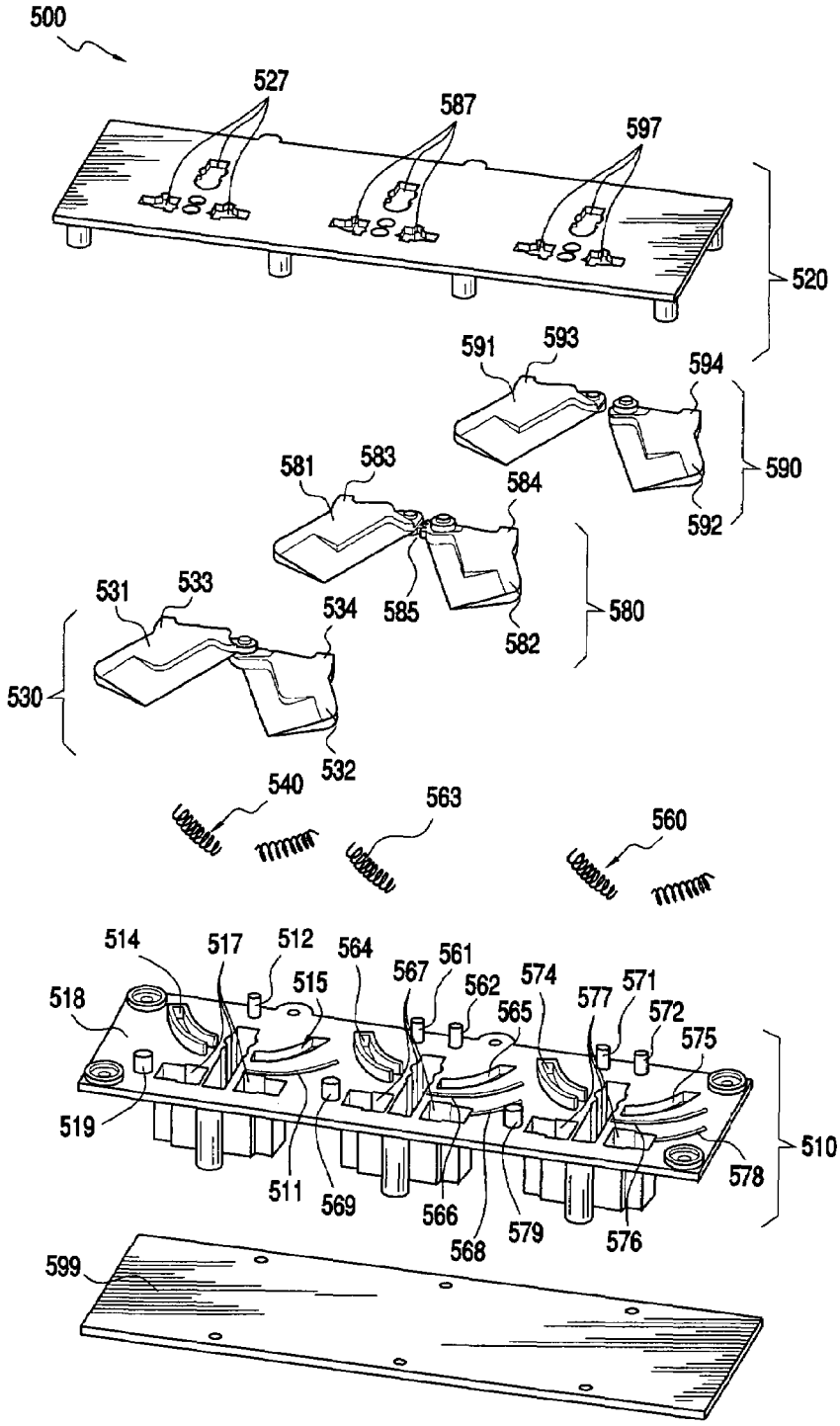
FIG. 5 is an exploded view of an electrical product according to an embodiment of the invention.

FIG. 5 is an exploded view of an electrical product 500 according to an embodiment of the invention. In the illustrated embodiment, electrical product 500 comprises a power strip having three electrical outlets. Alternative, non-illustrated, embodiments for electrical product 500 include a surge protector, an electronic device such as a power conditioner or a battery backup system that contains one or more electrical outlets, a multi-outlet adapter, or the like.

As illustrated, electrical product 500 comprises safety mechanisms of each of the three types discussed above. In other words, electrical product 500 contains safety mechanisms similar to each of safety mechanisms 110, 210, and 310 from FIGS. 1-3. The inclusion of three different types of safety mechanism in the illustration of electrical product 500 was motivated, at least in part, for its illustrative effect. Non-illustrated embodiments of electrical product 500 include only a single type of safety mechanism. Furthermore, the non-illustrated embodiments of electrical product 500 are not limited to products having three electrical outlets arranged in linear fashion, but can also include electrical outlets in any practical number, arranged in geometries of various descriptions, including double rows, circular patterns, staggered arrangements, or some other regular or irregular geometry.

As further illustrated in FIG. 5, electrical product 500 comprises a body 510 having a surface 518 and containing a plurality of electrical connections 517, a plurality of electrical connections 567, and a plurality of electrical connections 577. As an example, pluralities of electrical connections 517, 567, and 577 can be similar to plurality of electrical connections 417 in FIG. 4. Electrical product 500 further comprises a faceplate 520 covering body 510 and having therein a plurality of openings 527 corresponding to plurality of electrical connections 517, a plurality of openings 587 corresponding to plurality of electrical connections 567, and a plurality of openings 597 corresponding to plurality of electrical connections 577. As an example, pluralities of openings 527, 587, and 597 can be similar to plurality of openings 427 in FIG. 4. A lower plate 599 is located adjacent to body 510 opposite faceplate 520, and can be attached to faceplate 520 using screws, sonic welds, or some other fastening device or method.

Electrical product 500 still further comprises a safety barrier 530, a safety barrier 580, and a safety barrier 590. Safety barrier 530 is located between plurality of openings 527 and plurality of electrical connections 517, is coupled to a pivot point 512 about which it is capable of rotational motion between a first position, in which safety barrier 530 blocks each one of plurality of openings 527, and a second position, in which safety barrier 530 does not block any of plurality of openings 527, and is adjacent to a biasing member 540, which biases safety barrier 530 toward the first position. Safety barrier 580 is located between plurality of openings 587 and plurality of electrical connections 567, is coupled to pivot points 561 and 562 about which it is capable of rotational motion between a first position, in which safety barrier 580 blocks each one of plurality of openings 587, and a second position, in which safety barrier 580 does not block any of plurality of openings 587, and is adjacent to a biasing member 563, which biases safety barrier 580 toward the first position. Safety barrier 590 is located between plurality of openings 597 and plurality of electrical connections 577, is coupled to pivot points 571 and 572 about which it is capable of rotational motion between a first position, in which safety barrier 590 blocks each one of plurality of openings 597, and a second position, in which safety barrier 590 does not block any of plurality of openings 597, and is adjacent to a biasing member 560, which biases safety barrier 590 toward the first position.

Pivot points 512, 561, 562, 571, and 572 comprise posts extending away from body 510 toward faceplate 520. Pivot points 512, 561, 562, 571, and 572 are thus similar to pivot point 412 shown in FIG. 4.

Safety barrier 530 comprises a shutter 531 and a shutter 532, safety barrier 580 comprises a shutter 581 and a shutter 582, and safety barrier 590 comprises a shutter 591 and a shutter 592. As an example, shutters 531 and 532 can be similar to shutters 313 and 314 of FIG. 3, and to shutters 431 and 432 of FIG. 4. As another example, shutters 581 and 582 can be similar to shutters 213 and 214 of FIG. 2. As still another example, shutters 591 and 592 can be similar to shutters 113 and 114 of FIG. 1. As illustrated, shutters 531 and 532 are coupled to, and capable of rotational motion about, pivot point 512, shutters 581 and 582 are coupled to, and capable of rotational motion about, pivot points 561 and 562, respectively, and shutters 591 and 592 are coupled to, and capable of rotational motion about, pivot points 571 and 572, respectively.

In order to maintain a footprint for electrical product 500 that is similar to those for similar electrical products without safety mechanisms, safety barriers 530, 580, and 590 are located in close proximity to each other on body 510, so close, in fact, that adjacent shutters, such as shutters 582 and 591, or shutters 532 and 581, would collide with each other if both shutters were equidistant from surface 518 of body 510. To prevent such collisions, adjacent shutters are positioned at differing distances above surface 518. As an example, shutters 532, 582, and 592 are positioned at a first height above surface 518 in the illustrated embodiment, and shutters 531, 581, and 591 are positioned at a second, greater height above surface 518. Accordingly, shutter 582 is located between shutter 591 and surface 518, with shutter 591 elevated above shutter 582, such that shutter 582 rotates underneath shutter 591, and between shutter 591 and surface 518 of body 510. Similarly, when electrical product 500 comprises outlets in adjacent rows or columns, the shutters are designed to rotate through an angle sufficient to alternately cover and expose the plurality of electrical connections, but not so large as to encroach on the space occupied by any adjacent electrical outlet. In one embodiment, the angle of travel is between approximately twenty and thirty degrees. In a particular embodiment, a travel angle of approximately 25 degrees is appropriate.

Safety barrier 580 further comprises a coupling mechanism 585 linking shutter 581 and shutter 582. As an example, coupling mechanism 585 can be similar to coupling mechanism 255, first shown in FIG. 2. In a non-illustrated embodiment, additional safety barriers can also comprise a coupling mechanism, which can be similar to coupling mechanisms 255 and 585.

Body 510 comprises channels 514 and 515 capable of housing biasing member 540, channel 564 capable of housing biasing member 563, and channels 574 and 575 capable of housing biasing member 560. A channel 565 is an optional feature of body 510, since coupling mechanism 585 renders superfluous a biasing member that would reside in channel 565 in the absence of coupling mechanism 585. As illustrated, channels 514, 564, and 574 are elevated above surface 518 of body 510, so as to accommodate raised shutters 531, 581, and 591. Although it was not mentioned earlier, one or more of the channels described previously may also have this elevated configuration. In particular, channels 150, 250, 350, and 415 are shown as being elevated in their respective figures.

Shutter 531 comprises an extension arm 533 and shutter 532 comprises an extension arm 534. Similarly, shutter 581 comprises an extension arm 583, shutter 582 comprises an extension arm 584, shutter 591 comprises an extension arm 593, and shutter 592 comprises an extension arm 594. As an example, each of the extension arms mentioned in this paragraph can be similar to extension arms 433 or 434, both of which were first shown in FIG. 4. In an embodiment where channel 565 does not house a biasing member, extension arm 584 can be omitted as superfluous. Extension arms 533, 534, 583, 584, 593, and 594 at least partially cover channels 514, 515, 564, 565, 574, and 575, respectively, when safety barriers 530, 580, and 590 are in their respective first positions.

Body 510 further comprises a support feature 519 adjacent to electrical connections 517, a support feature 569 adjacent to electrical connections 567, and a support feature 579 adjacent to electrical connections 577. As an example, support features 519, 569, and 579 can be similar to support feature 419 shown in FIG. 4.

Body 510 further comprises a friction-reducing feature 511 adjacent to electrical connections 517, a friction-reducing feature 566 adjacent to electrical connections 567, and a friction-reducing feature 576 adjacent to electrical connections 577. In particular embodiments, additional friction-reducing features can be situated adjacent to any or all of electrical connections 517, 567, and 577. In the illustrated embodiment, for example, body 510 still further comprises a friction-reducing feature 568 adjacent to electrical connections 567 and a friction-reducing feature 578 adjacent to electrical connections 577. As an example, friction-reducing features 511, 566, 568, 576, and 578 can be similar to friction-reducing feature 421, shown in FIG. 4. Channels 514, 564, and 574 may also perform a friction-reducing function. To enhance this effect, channels 514, 564, and/or 574 may be provided with one or more raised bumps that offer a reduced-surface travel path for shutters 531, 581, and/or 591.

Figure 6:
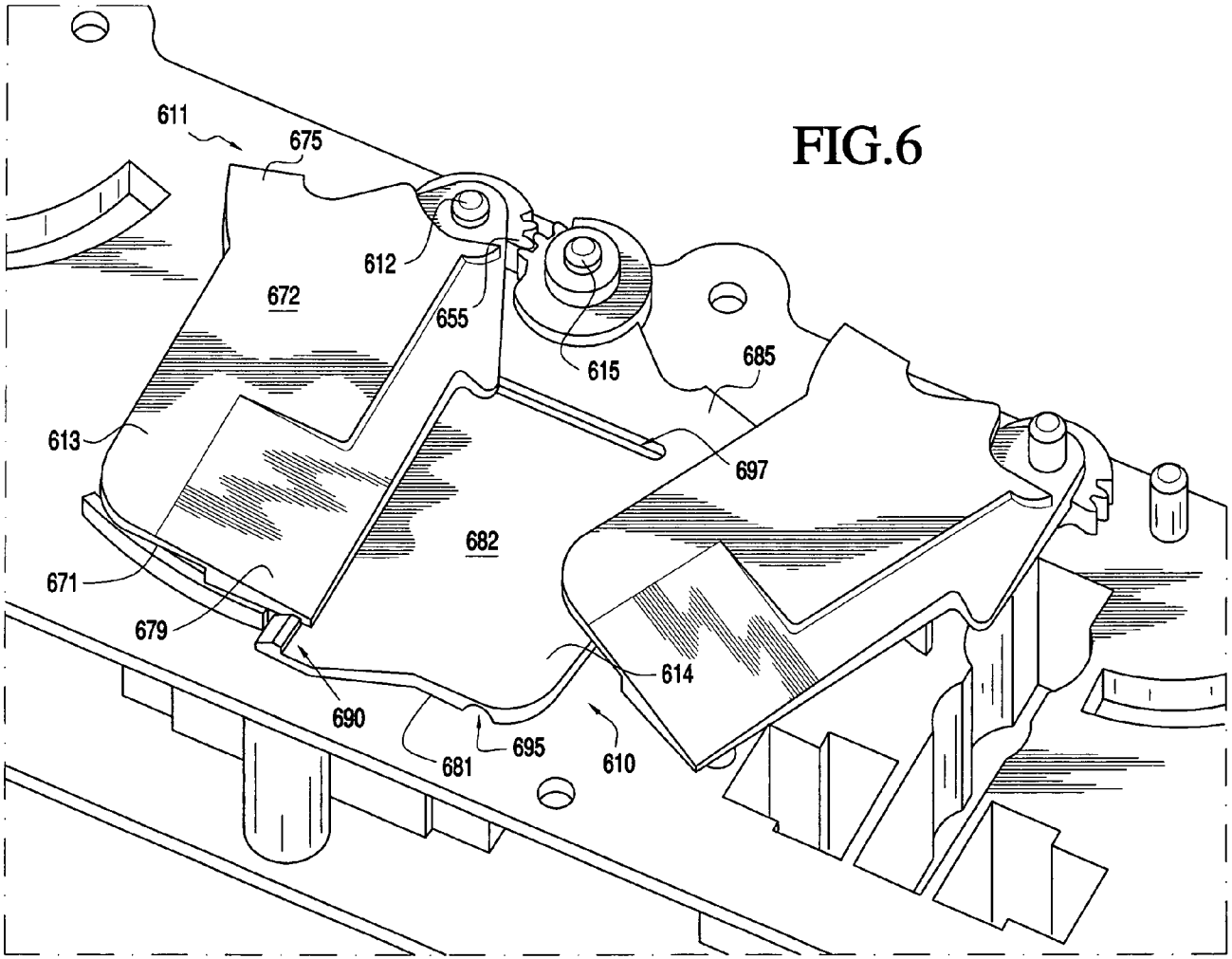
FIG. 6 is a perspective view of a safety mechanism capable of blocking an opening to an electrical connection in an electrical outlet according to still another embodiment of the invention.

FIG. 6 is a perspective view of a safety mechanism 610 according to an embodiment of the invention. Safety mechanism 610 is capable of blocking an opening or openings to an electrical connection in an electrical outlet, in a manner similar to that described above for safety mechanisms 110, 210, and 310. As an example, safety mechanism 610 can be used in electrical product 500 (see FIG. 5) in addition to or instead of any of the safety mechanisms described thus far herein. An adjacent safety mechanism for an adjacent electrical outlet in an electrical product is shown for visual context in FIG. 6, but the adjacent safety mechanism and electrical outlet of FIG. 6 are not further described herein.

As was the case in FIGS. 1, 2, and 3, the electrical connection is not illustrated in FIG. 6, but is located in the opening or openings and comprises an electrically conductive material electrically coupled to a source of electric current. Safety mechanism 610 comprises a safety barrier 611, which is rotatable between a first position, in which safety barrier 611 blocks the opening or openings to the electrical connection, and a second position, in which safety barrier 611 does not block the opening or openings to the electrical connection. Unlike in FIGS. 1, 2, and 3, no opening to the electrical connection is shown in FIG. 6 because safety barrier 611 is illustrated in the first position where the opening or openings are blocked by safety barrier 611.

As illustrated in FIG. 6, safety barrier 611 comprises a shutter 613 coupled to the electrical outlet at a pivot point 612 and a shutter 614 coupled to the electrical outlet at a pivot point 615. A coupling mechanism 655, which can be similar to coupling mechanism 255 (see FIG. 2) links shutters 613 and 614 together such that motion of one shutter forces motion of the other shutter. Shutter 613 comprises a surface 671 facing the electrical connections and a surface 672 opposite surface 671 and facing away from the electrical connections. Similarly, shutter 614 comprises a surface 681 facing the electrical connections and a surface 682 opposite surface 681 and facing away from the electrical connections. (Surfaces 671 and 681 are hidden from view in FIG. 6 by surfaces 672 and 682, respectively, such that only an edge of surface 671 and an edge of surface 681 are visible.) Surface 672 comprises a portion 679 that is angled with respect to surface 671. Surface 682 is parallel or substantially parallel to surface 681. As an example, pivot points 612 and 615, surfaces 671, 672, 681, and 682, and portion 679 can be similar to, respectively, pivot points 112 and 115, surfaces 171, 172, 181, and 182, and portion 179, all of which were first shown in FIG. 1.

Safety mechanism 610 further comprises channels that can be similar to channels 150 and 160, and still further comprises a biasing member that can be similar to biasing members 291, 440, 540, 560, and 563. Neither the channels nor the biasing member are visible in FIG. 6 because both the channels and the biasing member are hidden from view by shutters 613 and 614.

Shutter 613 of safety barrier 611 comprises an extension arm 675 oriented so as to be located over one of the channels when safety barrier 611 is in the first position. Similarly, shutter 614 of safety barrier 611 comprises an extension arm 685 oriented so as to be located over the other channel when safety barrier 611 is in the first position. This orientation of extension arms 675 and 685 tends to keep the biasing members in place within the channels. When safety barrier 611 is in the second position, surfaces 671 and 681 perform an equivalent function. In the absence of extension arms 675 and 685 or another component that performs an equivalent function, the biasing members may have a tendency to leave the channels, with possible detrimental effect to safety mechanism 610.

Except for the fact that shutter 614 is flat or substantially flat instead of angled, safety mechanism 610, with respect to the features thus far described, is substantially identical to safety mechanism 210, first shown in FIG. 2. Additional features of safety mechanism 610 will now be described, still with reference to FIG. 6. Although the additional features to be described immediately below were not shown or described in connection with safety mechanism 210 or any of the other safety mechanisms disclosed above, any one or more of the additional features may be incorporated into any or all of the safety mechanisms heretofore disclosed.

Safety mechanism 610 further comprises an interlock feature 690, a living hinge 695, and a slot 697. Interlock feature 690 helps maintain safety mechanism 610 in the first position when no plug is inserted in the electrical outlet by latching shutters 613 and 614 to each other or to another portion of safety mechanism 610. As an example, interlock feature 690 can comprise a cantilever arm, located on one of shutters 613 and 614, having a raised portion on an end of the cantilever arm capable of latching onto a protrusion located on the other one of shutters 613 and 614 or, for example, onto a portion of a housing of an electrical product of which safety mechanism 610 is a part. FIG. 6 does not show a housing, but see faceplate 520 in FIG. 5 for an example of a suitable portion of a housing of an electrical product. In an embodiment where interlock feature 690 comprises a cantilever arm, interlock feature 690 can be disengaged by an application of pressure on safety mechanism 610 having a component in the direction of the electrical connections. Such pressure will tend to flex the cantilever arm such that it separates from the protrusion onto which it was latched and can then move around and away from the protrusion. When the pressure on safety mechanism 610 is removed, the cantilever arm of interlock feature 690, under the influence of the biasing member mentioned above, will move toward and around the protrusion in a sense opposite that experienced during unlatching, thus once again latching safety mechanism 610 in the first position.

As illustrated, living hinge 695 is located in shutter 614, and comprises a region in which a portion of shutter 614 has been removed to create a thin and flexible bridge of material, as known in the art. Living hinge 695 allows shutter 614 to flex when pressure is applied to shutter 614. This ability to flex enables interlock feature 690 to function as described above, and also enables a smooth transition back and forth between the first and second positions for safety mechanism 610. Slot 697 allows shutter 614 to flex in response to pressure applied by, for example, a plug pressed against safety mechanism 610. Slot 697 relieves at least some of the stress that such flexure would otherwise bring to bear on pivot point 615 or another portion of safety mechanism 610.

Any or all of the safety mechanism discussed herein can be constructed at least in part from polyoxymethylene (POM), a material that has a very low coefficient of friction, high chemical and thermal resistance, and is rigid and dimensionally stable. Another suitable, and somewhat less expensive, material for any or all of the safety mechanisms discussed herein is Acrylonitrile Butadiene Styrene (ABS), which exhibits a pleasing surface quality, color fastness, and heat resistance.

Figure 7:
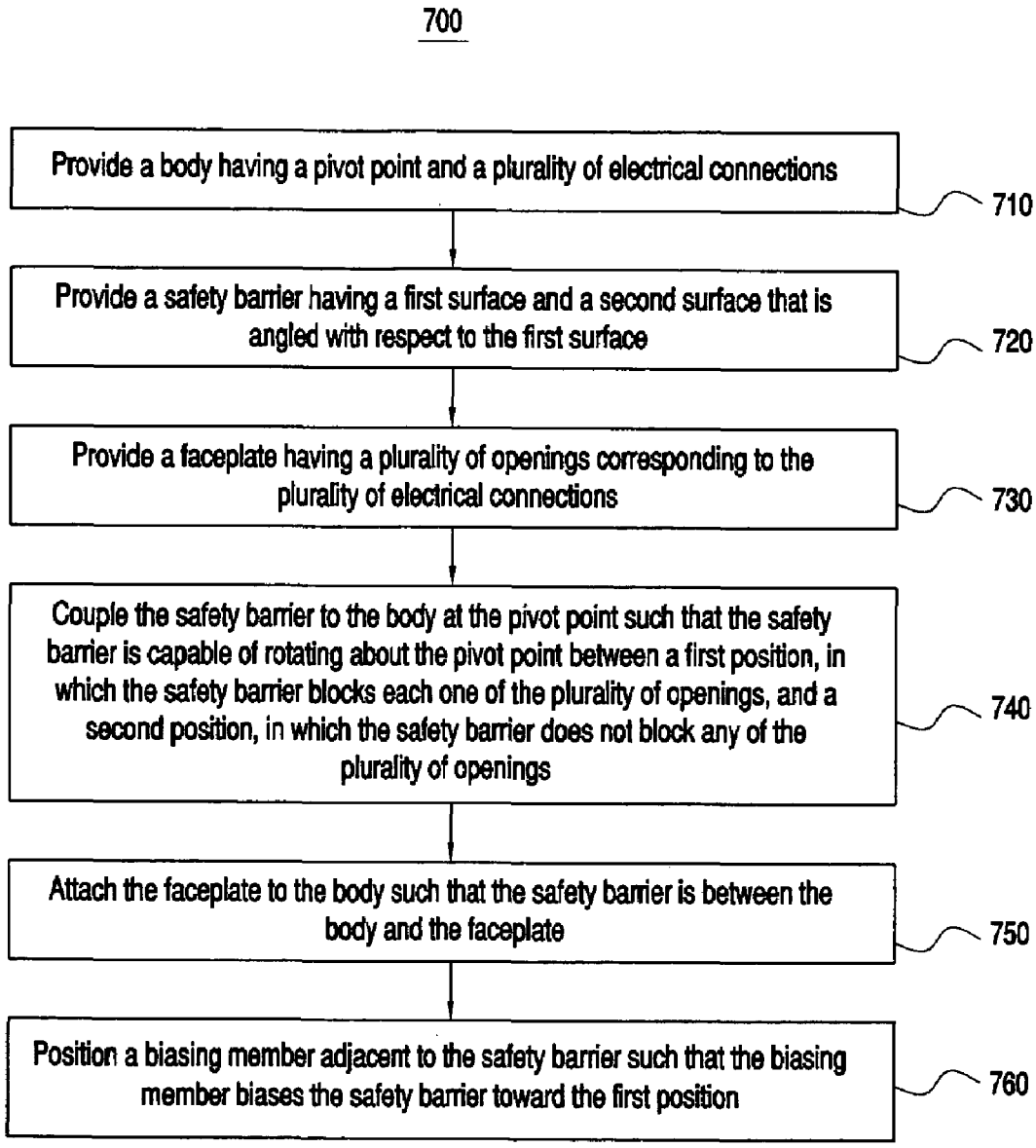
FIG. 7 is a flowchart illustrating a method of manufacturing an electrical outlet according to an embodiment of the invention.

FIG. 7 is a flowchart illustrating a method 700 of manufacturing an electrical outlet according to an embodiment of the invention. A step 710 of method 700 is to provide a body having a pivot point and a plurality of electrical connections. As an example, the pivot point can be similar to pivot points 112 and/or 115, first shown in FIG. 1. As another example, the plurality of electrical connections can be similar to plurality of electrical connections 417, first shown in FIG. 4. In one embodiment, step 710 or another step comprises one or both of forming a support feature on the body and forming a friction-reducing feature on the body. As an example, the support feature can be similar to support feature 419, first shown in FIG. 4. As another example, the friction-reducing feature can be similar to friction-reducing feature 421, also first shown in FIG. 4.

A step 720 of method 700 is to provide a safety barrier having a first surface and a second surface that is angled with respect to the first surface. As an example, the safety barrier can be similar to safety barriers 111, 211, 311, or 611, first shown in FIGS. 1, 2, 3, and 6, respectively. As another example, the first surface can be similar to surface 172, and the second surface can be similar to surface 171, both of which were first shown in FIG. 1.

A step 730 of method 700 is to provide a faceplate having a plurality of openings corresponding to the plurality of electrical connections. As an example, the faceplate can be similar to faceplate 420 or 520, first shown in FIGS. 4 and 5, respectively. As another example, the plurality of openings can be similar to plurality of openings 427, first shown in FIG. 4.

A step 740 of method 700 is to couple the safety barrier to the body at the pivot point such that the safety barrier is capable of rotating about the pivot point between a first position, in which the safety barrier blocks each one of the plurality of openings, and a second position, in which the safety barrier does not block any of the plurality of openings.

A step 750 of method 700 is to attach the faceplate to the body such that the safety barrier is between the body and the faceplate.

A step 760 of method 700 is to position a biasing member adjacent to the safety barrier such that the biasing member biases the safety barrier toward the first position. As an example, the biasing member can be similar to any of the biasing members described herein, including, for example, biasing member 291, first shown in FIG. 2. In one embodiment, step 760 or another step comprises forming a channel in the body, and positioning the biasing member adjacent to the safety barrier comprises placing the biasing member in the channel. As an example, the channel can be similar to any of the channels described herein, including, for example, channels 150 or 160, both of which were first shown in FIG. 1.

In one embodiment, step 720 or another step of method 700 comprises providing the safety barrier with an extension arm, and method 700 further comprises positioning the safety barrier such that the extension arm at least partially covers the channel when the safety barrier is in the first position. In the same or another embodiment, step 720 or another step of method 700 further comprises providing a first shutter and a second shutter, coupling the first shutter to the pivot point at a first height over the body, and coupling the second shutter to the pivot point at a second height over the body, where the first height is different from the second height. As an example, the extension arm can be similar to extension arm 175 or to extension arm 185, both of which were first shown in FIG. 1. As another example, the first shutter can be similar to shutters 113, 213, 313, or 613, first shown in FIGS. 1, 2, 3, and 6, respectively, and the second shutter can be similar to shutters 114, 214, 314, and 614, first shown in FIGS. 1, 2, 3, and 6, respectively.

Although the invention has been described with reference to specific embodiments, it will be understood by those skilled in the art that various changes may be made without departing from the spirit or scope of the invention. Various examples of such changes have been given in the foregoing description. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the safety mechanism and electrical outlets and products discussed herein may be implemented in a variety of embodiments, and that the foregoing discussion of certain of these embodiments does not necessarily represent a complete description of all possible embodiments.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. An electrical product comprising:

a body containing a first plurality of electrical connections and a second plurality of electrical connections;

a faceplate covering the body and having therein a first plurality of openings corresponding to the first plurality of electrical connections and a second plurality of openings corresponding to the second plurality of electrical connections;

a first safety barrier between the first plurality of openings and the first plurality of electrical connections, the first safety barrier adjacent to a first biasing member and coupled to, and capable of rotational motion about, a first pivot point;

a second safety barrier between the second plurality of openings and the second plurality of electrical connections, the second safety barrier adjacent to a second biasing member and coupled to, and capable of rotational motion about, a second pivot point;

wherein:

the first safety barrier comprises a first shutter and a second shutter;

the second safety barrier comprises a third shutter and a fourth shutter;

the second shutter is located between the first shutter and the third shutter;

the second shutter is elevated above the third shutter such that the third shutter rotates underneath the second shutter and between the second shutter and the body;

the first safety barrier is rotatable between a first position, in which the first safety barrier blocks each one of the first plurality of openings, and a second position, in which the first safety barrier does not block any of the first plurality of openings;

the second safety barrier is rotatable between a third position, in which the second safety barrier blocks each one of the second plurality of openings, and a fourth position, in which the second safety barrier does not block any of the second plurality of openings;

the first biasing member biases the first safety barrier toward the first position; and the second biasing member biases the second safety barrier toward the third position.

2. The electrical product of claim 1 wherein:

the first safety barrier comprises:

a first surface facing the first plurality of electrical connections; and a second surface opposite the first surface and facing away from the first plurality of electrical connections;

the second safety barrier comprises:

a third surface facing the second plurality of electrical connections; and a fourth surface opposite the third surface and facing away from the second plurality of electrical connections;

the first surface and the third surface are substantially parallel to the faceplate;

a portion of the second surface is angled with respect to the first surface; and a portion of the fourth surface is angled with respect to the third surface.

3. A safety mechanism capable of blocking an opening to an electrical connection in an electrical outlet, the safety mechanism comprising:

a safety barrier coupled to the electrical outlet at a Divot point and rotatable between a first position, in which the safety barrier blocks the opening, and a second position, in which the safety barrier does not block the opening;

a faceplate containing the opening; and a biasing member adjacent to the safety barrier, wherein:

the biasing member biases the safety barrier toward the first position;

the safety barrier further comprises:

a first surface facing the electrical connection; and a second surface opposite the first surface and facing away from the electrical connection;

a first shutter coupled to the electrical outlet at the pivot point; and a second shutter coupled to the electrical outlet at a second pivot point;

the first surface is substantially parallel to the faceplate; and a portion of the second surface is angled with respect to the first surface.

4. The safety mechanism of claim 3 wherein:

at least one of the first shutter and the second shutter comprises at least one of an interlock feature and a living hinge; and the safety barrier further comprises a coupling mechanism linking the first shutter and the second shutter.

5. The safety mechanism of claim 4 wherein:

the coupling mechanism comprises a gear system.

6. The safety mechanism of claim 3 wherein:

the biasing member comprises a spring.

7. The safety mechanism of claim 3 wherein:

the biasing member is adjacent to the first shutter;

the safety mechanism further comprises a second biasing member;

the second biasing member is adjacent to the second shutter; and the first shutter and the second shutter can move independently of each other.

8. A safety mechanism capable of blocking an opening to an electrical connection in an electrical outlet, the safety mechanism comprising:

a safety barrier coupled to the electrical outlet at a pivot point and rotatable between a first position, in which the safety barrier blocks the opening, and a second position, in which the safety barrier does not block the opening;

a faceplate containing the opening; and a biasing member adjacent to the safety barrier, wherein:

the biasing member biases the safety barrier toward the first position;

the safety barrier comprises:

a first surface facing the electrical connection; and a second surface opposite the first surface and facing away from the electrical connection;

a first shutter coupled to the electrical outlet at the pivot point; and a second shutter coupled to the electrical outlet at the pivot point; and the safety barrier is located between the faceplate and the electrical connection;

the first surface is substantially parallel to the faceplate; and a portion of the second surface is angled with respect to the first surface.

9. The electrical product of claim 2 wherein:

the first pivot point comprises a first post extending away from the body toward the faceplate; and the second pivot point comprises a second post extending away from the body toward the faceplate.

10. The electrical product of claim 9 wherein:

the body further comprises:

a surface;

a support feature on the surface of the body; and a friction-reducing feature on the surface of the body.

11. An electrical outlet comprising:

a body containing a plurality of electrical connections;

a faceplate covering the body and having therein a plurality of openings corresponding to the plurality of electrical connections;

a safety barrier between the faceplate and the body; and a biasing member adjacent to the safety barrier, wherein:

the safety barrier comprises a portion that is angled with respect to the faceplate;

the safety barrier is coupled to the body at a pivot point;

the safety barrier is rotatable between a first position, in which the safety barrier blocks each one of the plurality of openings, and a second position, in which the safety barrier does not block any of the plurality of openings; and the safety barrier comprises:

a first shutter coupled to the body at the pivot point; and a second shutter coupled to the body at a second pivot point; and the biasing member biases the safety barrier toward the first position.

12. The electrical outlet of claim 11 wherein:

the safety barrier further comprises a coupling mechanism linking the first shutter and the second shutter and preventing the first shutter and the second shutter from moving independently of each other.

13. The electrical outlet of claim 12 wherein:

the coupling mechanism comprises a gear system.

14. The electrical outlet of claim 13 wherein:

the biasing member comprises a spring.

15. The electrical outlet of claim 11 wherein:

the biasing member is adjacent to the first shutter;

the electrical outlet further comprises a second biasing member;

the second biasing member is adjacent to the second shutter; and the first shutter and the second shutter are capable of moving independently of each other.

16. An electrical outlet comprising:

a body containing a plurality of electrical connections;

a faceplate covering the body and having therein a plurality of openings corresponding to the plurality of electrical connections;

a safety barrier between the faceplate and the body; and biasing member adjacent to the safety barrier, wherein:

the safety barrier comprises a portion that is angled with respect to the faceplate;

the safety barrier is coupled to the body at a pivot point;

the safety barrier is rotatable between a first position, in which the safety barrier blocks each one of the plurality of openings, and a second position, in which the safety barrier does not block any of the plurality of openings;

the safety barrier comprises:

a first shutter coupled to the body at the pivot point; and a second shutter coupled to the body at the pivot point; and at least one of the first shutter and the second shutter comprises an interlock feature and a living hinge; and the biasing member biases the safety barrier toward the first position.

17. An electrical outlet comprising:

a body containing a plurality of electrical connections;

a faceplate covering the body and having therein a plurality of openings corresponding to the plurality of electrical connections;

a safety barrier between the faceplate and the body; and a biasing member adjacent to the safety barrier, wherein:

the safety barrier comprises a portion that is angled with respect to the faceplate;

the safety barrier is coupled to the body at a pivot point;

the safety barrier is rotatable between a first position, in which the safety barrier blocks each one of the plurality of openings, and a second position, in which the safety barrier does not block any of the plurality of openings; and the biasing member biases the safety barrier toward the first position; and the body comprises:

a first cavity containing a hot electrical connection;

a second cavity containing a neutral electrical connection;

a third cavity containing a ground electrical connection;

a channel capable of housing the biasing member; and a surface adjacent to the channel and to the first, second, and third cavities; and the hot electrical connection, the neutral electrical connection, and the ground electrical connection are at least some of the plurality of electrical connections.

18. The electrical outlet of claim 17 wherein:

the safety barrier comprises an extension arm.

19. The electrical outlet of claim 17 wherein:

the pivot point comprises a post located on the surface of the body and extending away from the body toward the faceplate.

20. The electrical outlet of claim 19 wherein:

the body further comprises:

a support feature on the surface of the body; and a friction-reducing feature on the surface of the body.

21. The electrical outlet of claim 17 wherein:

the safety barrier comprises a first shutter and a second shutter;

the biasing member is adjacent to the first shutter;

the electrical outlet further comprises a second biasing member;

the second biasing member is adjacent to the second shutter; and the body further comprises a second channel capable of housing the second biasing member.

22. The electrical product of claim 2 wherein:

the body comprises:

a first channel capable of housing the first biasing member; and a second channel capable of housing the second biasing member.

23. The electrical product of claim 22 wherein:

the first safety barrier comprises a first extension arm;

the second safety barrier comprises a second extension arm;

the first extension arm at least partially covers the first channel when the first safety barrier is in the first position;

the second extension arm at least partially covers the second channel when the second safety barrier is in the third position; and at least one of the first shutter and the second shutter comprises an interlock feature and a living hinge.

24. The electrical product of claim 2 wherein:

the first shutter and the second shutter are coupled to, and capable of rotational motion about, the first pivot point; and the third shutter and the fourth shutter are coupled to, and capable of rotational motion about, the second pivot point.

25. The electrical product of claim 2 wherein:

the first shutter is coupled to, and capable of rotational motion about, the first pivot point;

the second shutter is coupled to, and capable of rotational motion about, a third pivot point;

the third shutter is coupled to, and capable of rotational motion about, the second pivot point; and the fourth shutter is coupled to, and capable of rotational motion about, a fourth pivot point.

26. The electrical product of claim 2 wherein:

the first safety barrier further comprises a first coupling mechanism linking the first shutter and the second shutter; and the second safety barrier further comprises a second coupling mechanism linking the third shutter and the fourth shutter.

* * * * *

UNITED STATES PATENT AND TRADEMARK OFFICE

CERTIFICATE OF CORRECTION

PATENT NO. : 7,438,567 B2
APPLICATION NO. : 11/024593
DATED : October 21, 2008
INVENTOR(S) : Nalwad et al.

It is certified that error appears in the above-identified patent and that said Letters Patent is hereby corrected as shown below:

At column 15, line 13, cancel the word "Divot" and insert the word --pivot--.

At column 16, line 67, insert the word --a-- before the word "biasing".

Signed and Sealed this

Ninth Day of December, 2008

JON W. DUDAS
*Director of the United States Patent and Trademark Office*